US007271372B2

(12) United States Patent
Liu et al.

(10) Patent No.: US 7,271,372 B2
(45) Date of Patent: Sep. 18, 2007

(54) POWER CONTROL APPARATUS AND METHOD FOR ELECTRIC COOKERS

(75) Inventors: Yuan-Ho Liu, Fengyuan (TW); Chun-Hsiung Chen, Hsinchu (TW); Chun-Ku Lin, Boashan Shiang (TW)

(73) Assignee: Holtek Semiconductor, Hsinchu (TW)

( * ) Notice: Subject to any disclaimer, the term of this patent is extended or adjusted under 35 U.S.C. 154(b) by 0 days.

(21) Appl. No.: 11/200,019

(22) Filed: Aug. 10, 2005

(65) Prior Publication Data

US 2007/0012684 A1 Jan. 18, 2007

(30) Foreign Application Priority Data

Jul. 12, 2005 (TW) ..... 94123489

(51) Int. Cl.
*H05B 6/68* (2006.01)

(52) U.S. Cl. ..... 219/620; 219/716

(58) Field of Classification Search ..... 219/620, 219/635, 626–627, 650, 660, 661, 663, 664, 219/667, 719, 720, 725, 746, 497, 482, 488, 219/489, 490, 492, 716, 760; 710/100
See application file for complete search history.

(56) References Cited

U.S. PATENT DOCUMENTS

| | | | | |
|---|---|---|---|---|
| 5,001,318 | A * | 3/1991 | Noda | 219/716 |
| 6,756,689 | B2 | 6/2004 | Nam et al. | 257/783 |
| 6,774,465 | B2 | 8/2004 | Lee et al. | 257/671 |
| 2002/0108006 | A1 * | 8/2002 | Snyder | 710/100 |
| 2005/0242779 | A1 * | 11/2005 | Yoshio | 320/134 |

* cited by examiner

*Primary Examiner*—Quang Van
(74) *Attorney, Agent, or Firm*—Troxell Law Office, PLLC

(57) ABSTRACT

A power control apparatus for electric cookers includes an input unit, an output unit, a micro controller unit (MCU), having a programmer pulse generator (PPG) and at least an analog/digital converter built therein, a power circuit, an exciter-coil circuit, an output circuit of insulated gate bipolar transistor (IGBT), and a drive circuit of insulated gate bipolar transistor (IGBT). A command can be inputted externally to the MCU for restarting or stopping the output of the PPG and the PPG is capable of outputting pulses of programmable pulse width.

6 Claims, 3 Drawing Sheets

POWER CONTROL APPARATUS AND METHOD FOR ELECTRIC COOKERS

1. FIELD OF THE INVENTION

The present invention relates to a power control apparatus and method for electric cookers, and more particularly, to a power control apparatus utilizing a micro controller unit (MCU) with at least a programmable pulse generator (PPG) built therein, by which the power control apparatus can be programmed by a software enabling the design of the electric cookers to be simplified and thus the cost of the electric cookers to be reduced.

2. BACKGROUND OF THE INVENTION

The marketplace continues to demand lighter and thinner electronic devices. As a result, even the manufactures of consumer products are required to produce lighter, thinner products for competing in the market. By virtue of this, electric cookers of compact design, such as electromagnetic oven, electric rice cooker, and so on, which are cheaper and simpler to operate, are going to replace the standing of the conventional gas oven in our kitchen.

Since the aforesaid electric cookers are powered by electricity, it is important to be able to control and protect the power devices used in the electric cookers. Please refer to FIG. 1, which is a function block diagram depicting a power control module of a conventional electric cooker. As seen in FIG. 1, the prior-art power control module comprises: a micro controller unit (MCU) 11, an input unit 12, an output unit 13, a detection circuit 14, a drive circuit of insulated gate bipolar transistor (IGBT) 15, an output circuit of insulated gate bipolar transistor (IGBT) 16, an exciter-coil circuit 17, and a power circuit 18. Wherein, the input unit 12 further comprises a keyboard 121 and a temperature sensor 122, and the output unit further comprises a fan 131, a buzzer 132 and a display 133. With respect to the power control module of FIG. 1, it is noted that at least four comparators are required for enabling the MCU 111 to operate corresponding to the signals of synchronous (SYN), oscillation (OS), over-voltage (OV) and over-current (OC), etc. detected by the detection circuit 14. Moreover, for enabling the MCU 11 to execute a process of power control and circuit protection, more comparators along with other peripheral components are required. Thus, the prior-art power control module will have a complex control circuit that cause a high manufacturing cost. It is therefore in need of a cheaper and simpler power control apparatus.

SUMMARY OF THE INVENTION

In view of the disadvantages of prior art, the primary object of the present invention is to provide a micro controller unit (MCU) having a programmer pulse generator (PPG) and at least an analog/digital converter built therein, by which a command can be inputted externally to the MCU for restarting or stopping the output of the PPG while enabling the pulse width of pulses generated by the PPG to be programmed by a software in view of power control and protection.

Another object of the invention is to provide a power control apparatus, capable of protecting the circuits thereof by stopping the output of a PPG built therein or by adjusting the pulse width of the pulses generated by the PPG while detecting an over-voltage, over-current or over-temperature signal, in addition, to provide a cheaper power control apparatus with comparative simple circuit design and less peripheral components.

To achieve the above objects, the present invention provide a power control apparatus for electric cooker, which comprises:

- an input unit, for setting parameters of temperature control, power control and timing control;
- an output unit, for displaying parameters of temperature, power and timing;
- a micro controller unit (MCU), being used for processing the inputs of the input unit and controlling the outputs to the output unit while detecting signals of synchronization (SYN), oscillation (OS), over-voltage (OV), and over-current (OC);
- a power circuit, for providing power to the power control apparatus;
- an exciter-coil circuit, for adjusting the power of the power control apparatus;
- an output circuit of insulated gate bipolar transistor (IGBT), for driving the exciter-coil circuit; and
- a drive circuit of insulated gate bipolar transistor (IGBT), being used as voltage transformation interface between the MCU and the output circuit of insulated gate bipolar transistor (IGBT) while being used for driving the output circuit of insulated gate bipolar transistor (IGBT).

Moreover, to achieve he above objects, the present invention provide a power control method for electric cooker, adapted for controlling the processes of a MCU built in a power control apparatus, which comprises the step of:

(1) using a comparator as a signal source for providing signals to control the restart and output of a programmable pulse generator (PPG) arranged in a MCU, while using a timer and a prescaler for timing and controlling the specific output time of the PPG, wherein the setting of the timer and the prescaler is programmed by a software, and the output of the PPG is stopped as soon as the timing of the specific output time is up;

(2) using another comparator to provide a signal for stopping the output of the PPG;

(3) controlling the output time of the PPG by using timer cooperating with the prescaler; and (4) using a control element for disabling/enabling the two comparators, and for setting up the timer and the prescaler, and for restarting a disable/enable control, and for stopping the disable/enable control, and for controlling the output of the PPG with respect to the software, and for detecting the status of the PPG.

Other aspects and advantages of the present invention will become apparent from the following detailed description, taken in conjunction with the accompanying drawings, illustrating by way of example the principles of the present invention.

DESCRIPTION OF THE PREFERRED EMBODIMENT

For your esteemed members of reviewing committee to further understand and recognize the fulfilled functions and structural characteristics of the invention, several preferable embodiments cooperating with detailed description are presented as the follows.

Figure 1:
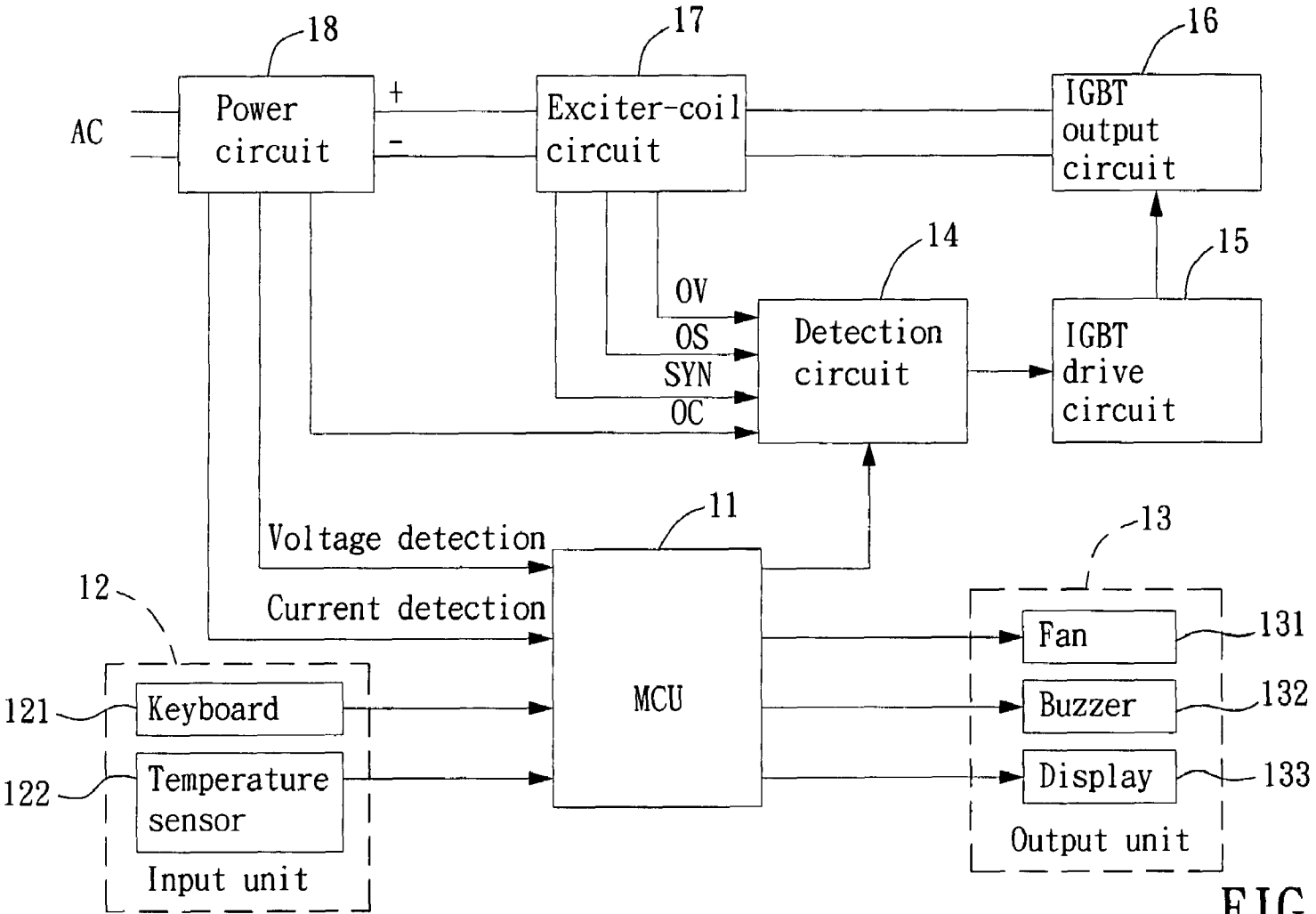
FIG. 1 (PRIOR ART)
FIG. 1 is a function block diagram depicting a power control module of a conventional electric cooker.
Figure 2:
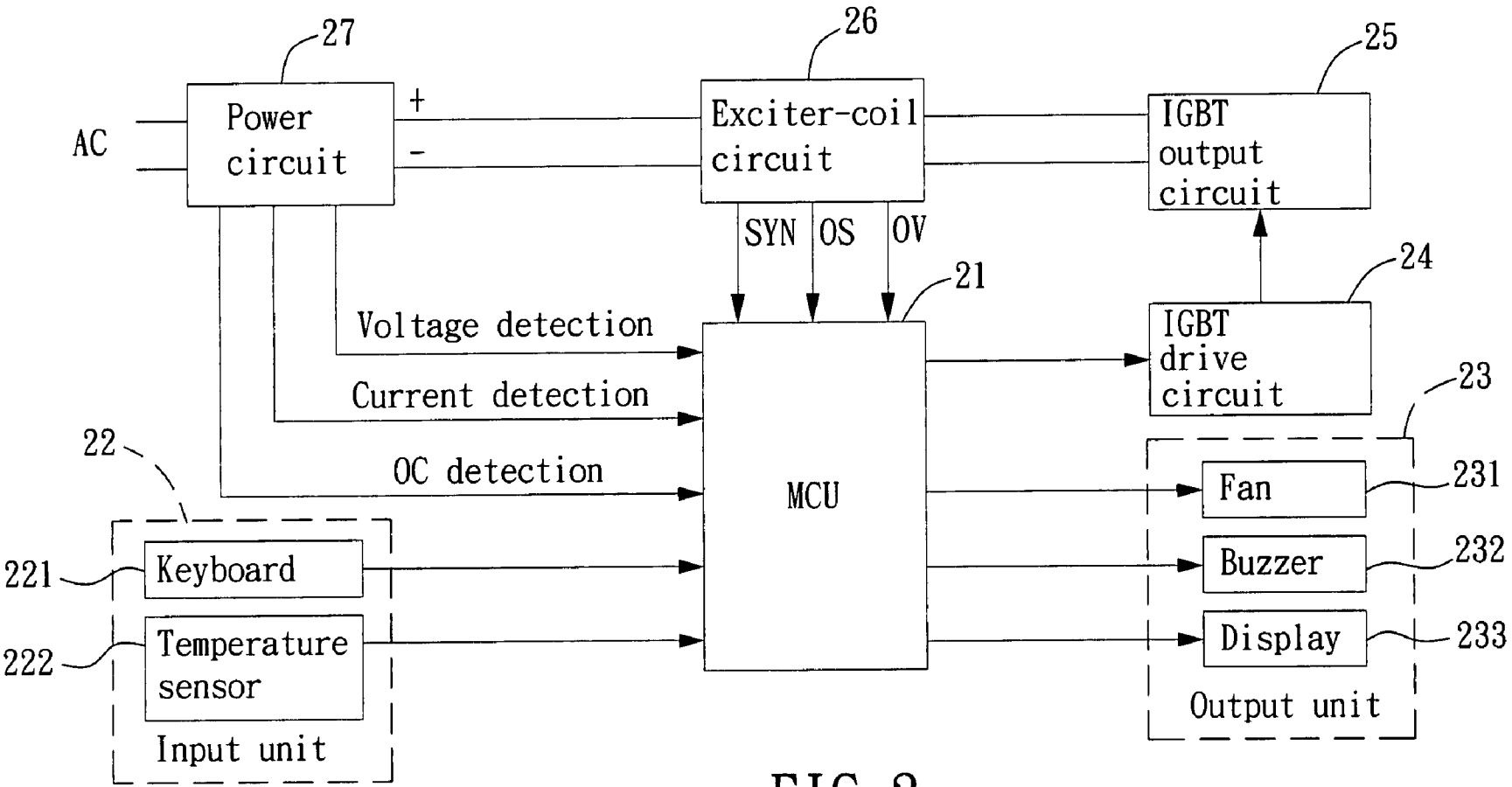
FIG. 2 is a function block diagram depicting a power control apparatus according to the present invention.

Please refer to FIG. 2, which is a function block diagram depicting a power control apparatus for electric cookers according to the present invention. The power control apparatus of FIG. 2 can be adapted for electric cookers, such as electromagnetic oven, electric rice cooker, and so on, which comprises:

an input unit 22, having a keyboard 221 and a temperature sensor 222 arranged therein, for setting parameters of temperature control, power control and timing control;

an output unit 23, for displaying parameters of temperature, power and timing, further comprising a fan 231, a buzzer, 232 and a display 233;

a micro controller unit (MCU) 21, being used for processing the inputs of the input unit 22 and controlling the outputs to the output unit 23 while detecting signals of synchronization (SYN), oscillation (OS), over-voltage (OV), and over-current (OC);

a power circuit 27, for providing power to the power control apparatus;

an exciter-coil circuit 26, for adjusting the power of the power control apparatus;

an output circuit of insulated gate bipolar transistor 25, for driving the exciter-coil circuit 26; and a drive circuit of insulated gate bipolar transistor (IGBT) 24, being used as voltage transformation interface between the MCU 21 and the output circuit of insulated gate bipolar transistor (IGBT) 25 while being used for driving the output circuit of insulated gate bipolar transistor (IGBT) 25.

Figure 3:
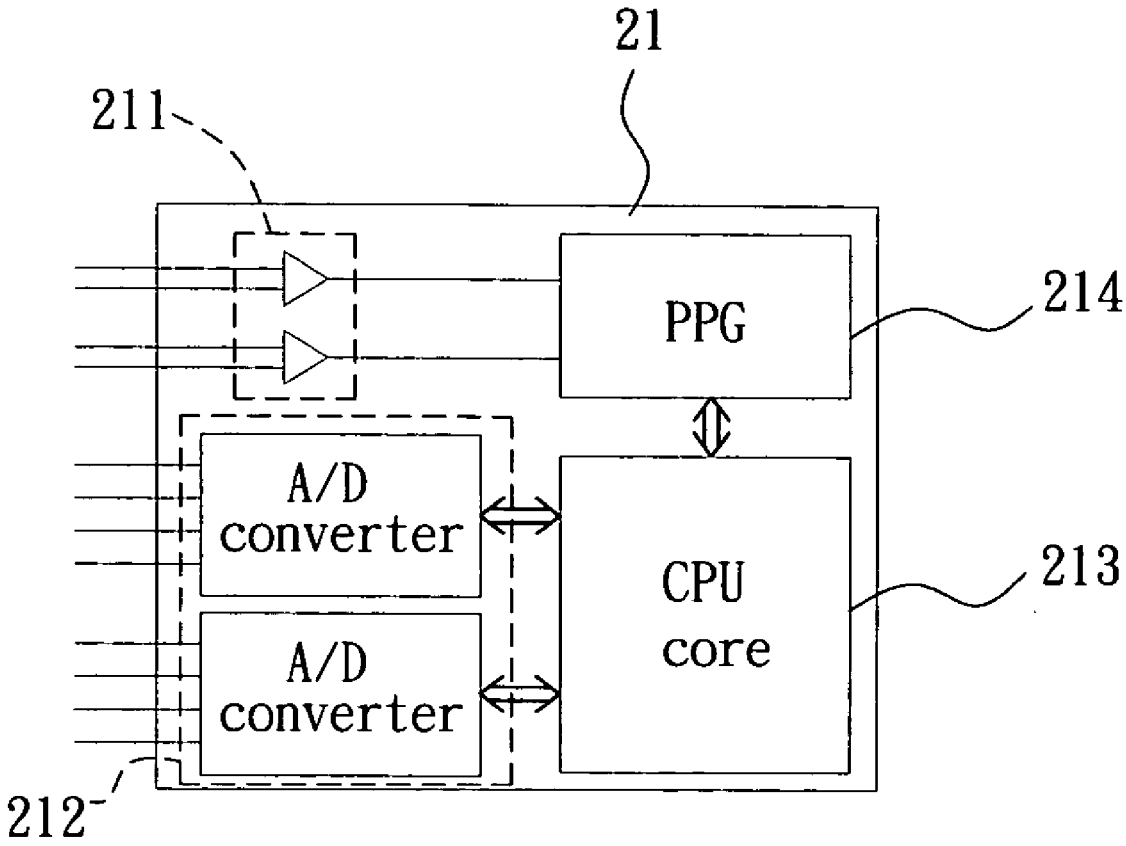
FIG. 3 is a function block diagram of a micro controller unit according to the present invention.

Please refer to FIG. 3, which is a function block diagram of a micro controller unit according to the present invention. The micro controller unit (MCU) of the invention further comprises:

at least an analog/digital (A/D) converter 212, whereas there are two A/D converters 212 being arranged in the MCU of FIG. 3;

a programmable pulse generator (PPG) 214, further comprising at least a comparator 211, a timer, a prescaler, and a control element, whereas there are a first comparator and a second comparator being arranged in the MCU of FIG. 3; and a processing core 213, for controlling the control unit of the programmable pulse generator 214.

There are a plurality of signals being detected and processed by the MCU of the power control apparatus of the invention, which are being described and analyzed in detail as following:

(1) signal of over-voltage (OV): While an IGBT is subjected to an ON/OFF control, the exciter-coil circuit 26 connected thereto may produce an over voltage and is being used as an over-voltage signal after being divided by a voltage divider of resistors, which is then being fed to the input of an A/D converter 212 arranged in the MCU 21 and used by the MCU 21 as a reference parameter of power control.

(2) signal of over-current (OC): When an instantaneous current passing an insulated gate bipolar transistor (IGBT) is larger than a specific value by a predetermined amount, an response is generated on the OC terminal of a current transformer (CT) arranged in the power circuit 27 which is connected to the C0VIN− terminal of the MCU 21, being the negative of the first comparator, and voltage generated according to the response is larger than a reference voltage of the C0VIN+terminal of the MCU 21, being the positive of the first comparator, a falling edge is occurring at the output (i.e. C0OUT) of the first comparator for enabling the PPG to stop.

(3) signals detected in the power circuit: A signal of SYSV acquired in the power circuit by a voltage divider of resistor and a signal of SYSC acquired with reference to the CT of the power circuit are being fed respectively to the analog inputs of the MCU 21, where the two signals are used to acquire a power value, which is being used as a reference parameter of power control, that is, being used as a reference for adjusting the width of the pulses generated by the PPG 214.

(4) signal of synchronization (SYN): By a voltage divider of resistors, signals of SYN-P and SYN-I can be acquired respectively from the two end of the excitor-coil circuit 26, wherein the signal of SYN-P is being adopted as the reference voltage of the C1VIN+ of the MCU 21, i.e. the positive of the second comparator, and the signal of SYN-I being referred as synchronous signal is connected to the C1VIN− of the MCU 21, i.e. the negative of the second comparator, such that when the signal of SYN-I is lower than the signal of SYN-P, the second comparator will restart the output of the PPG 214.

From the above description, a power control method for electric cooker can be provided, which comprises the step of:

(1) using a second comparator as a signal source for providing signals to control the restart and output of a programmable pulse generator (PPG) arranged in a MCU, while using a timer and a prescaler for timing and controlling a specific output time of the PPG, wherein the setting of the timer and the prescaler is programmed by a software, and the output of the PPG is stopped as soon as the timing of the specific output time is up;

(2) using a first comparator to provide a signal for stopping the output of the PPG;

(3) controlling the output time of the PPG by using timer cooperating with the prescaler; and (4) using a control element for disabling/enabling the first and second comparators, and for setting up the timer and the prescaler, and for restarting a disable/enable control, and for stopping the disable/enable control, and for controlling the output of the PPG with respect to the software, and for detecting the status of the PPG.

In addition, the programmable pulse generator (PPG) arranged in the micro controller unit is controlled by a means comprising the steps of:

(a) stopping the output of the PPG while a falling edge being generated at an output (C0OUT) of the first comparator and a P0SPEN bit being enabled, i.e. when an instantaneous current passing an insulated gate bipolar transistor (IGBT) is larger than a specific value by a predetermined amount, an response is generated on the OC terminal of a current transformer (CT) which is connected to the C0VIN−terminal of the MCU, being the negative of the first comparator, and voltage generated according to the response is larger than a reference voltage of the C0VIN+terminal of the MCU, being the positive of the first comparator, the falling edge is occurring at the output (i.e. C0OUT) of the first comparator for enabling the stop of the PPG; and similarly, when a temperature is too high to cause the corresponding voltage at he C0VIN−terminal to be higher than the reference voltage of the C0VIN+terminal, the output of the PPG is stopped;

(b) restarting the output of the PPG while a falling edge being generated at an output (C1OUT) of the second comparator and a P1 SPEN bit being enabled, i.e. when the voltage of an terminal of a exciter-coil circuit, which is being connected the insulated gate bipolar transistor (IGBT), is dropped from a high potential to zero potential, the PPG is restarted, i.e. when the voltage representing a synchronous signal SYN-I is lower than that of another synchronous signal SYN-P, a falling edge is generated at the output (i.e. C1OUT) of the second comparator for enabling the restart of the PPG;

(c) enabling the restarting and the stopping of the PPG by using a software to detect/program the status of a POST bit;

(d) employing the PPG as a timer while using a software to set up the timer and a prescaler, both for timing and controlling a specific output time of the PPG, which is referred as the pulse width of the PPG, and thus achieving an object of power control;

(e) detecting and controlling signals of synchronization (SYN), oscillation (OS), over-voltage (OV), and over-current (OC) with respect to the process of step (a) to step (d).

As seen in FIG. 2 and FIG. 3, it is noted that the present invention can provide a micro controller unit (MCU) having a programmer pulse generator (PPG) and at least an analog/digital converter built therein, by which a command can be inputted externally to the MCU for restarting or stopping the output of the PPG while enabling the pulse width of pulses generated by the PPG to be programmed by a software in view of power control and protection.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A power control apparatus for a electric cooker, comprising:

an input unit, for setting parameters of temperature control, power control and timing control;

an output unit, for displaying parameters of temperature, power and timing;

a micro controller unit (MCU), being used for processing the inputs of the input unit and controlling the outputs to the output unit while detecting signals of synchronization (SYN), oscillation (OS), over-voltage (OV), and over-current (OC); a power circuit, for providing power to the power control apparatus;

an exciter-coil circuit, for adjusting the power of the power control apparatus; an output circuit of insulated gate bipolar transistor, for driving the exciter-coil circuit; and a drive circuit of insulated gate bipolar transistor (IGBT), being used as voltage transformation interface between the MCU and the output circuit of insulated gate bipolar transistor (IGBT) while being used for driving the output circuit of insulated gate bipolar transistor (IGBT), wherein the micro controller unit further comprises:

at least an analog/digital converter;

a programmable pulse generator (PPG), comprising at least a comparator, a timer, a prescaler, and a control element; and a processing core, for controlling the control unit of the programmable pulse generator, wherein the MCU is configured to be externally commanded to restart or stop the power output of the PPG while enabling the pulse width of pulses generated by the PPG to be programmed by software for power control and safety.

2. The power control apparatus of claim 1, wherein the input unit further comprises a keyboard and a temperature sensor.

3. The power control apparatus of claim 1, wherein the output unit further comprises a fan, a buzzer and a display.

4. The power control apparatus of claim 1, wherein the micro controller unit further comprises a power detection circuit.

5. The power control apparatus of claim 1, wherein the electric cooker is a electro-magnetic oven.

6. The power control apparatus of claim 1, wherein the electric cooker is an electric rice cooker.

* * * * *